United States Patent [19]

Smith

[11] 4,207,725

[45] Jun. 17, 1980

[54] PACKAGE AND METHOD OF PACKAGE USE

[75] Inventor: Ernest L. Smith, Kansas City, Mo.

[73] Assignee: Phillips Petroleum Company, Bartlesville, Okla.

[21] Appl. No.: 937,666

[22] Filed: Aug. 28, 1978

Related U.S. Application Data

[60] Division of Ser. No. 674,185, Apr. 6, 1976, Pat. No. 4,127,187, which is a continuation of Ser. No. 475,979, Jun. 5, 1974, abandoned.

[51] Int. Cl.[2] ..... B65B 7/28

[52] U.S. Cl. ..... 53/471; 206/219

[58] Field of Search ..... 53/471; 206/219, 220; 229/1.5 B, 43

[56] References Cited

U.S. PATENT DOCUMENTS

| | | | |
|---|---|---|---|
| 1,885,757 | 11/1932 | Orlopp | 206/219 |
| 2,487,236 | 11/1949 | Greenberg | 206/219 X |
| 3,301,464 | 1/1967 | Amberg | 229/43 |
| 3,502,206 | 3/1970 | Hultberg et al. | 229/1.5 B |

*Primary Examiner*—Travis S. McGehee

[57] ABSTRACT

A container is provided with a rupturable sealing partition which is protected by a closure member to form a package. The rupturable partition is located within the container to separate a lower product-containing portion from an upper measuring portion thereof.

7 Claims, 3 Drawing Figures

PACKAGE AND METHOD OF PACKAGE USE

This application is a division of copending application Ser. No. 674,185, Apr. 6, 1976, now U.S. Pat. No. 4,127,187, which was a continuation of application Ser. No. 475,979, filed June 5,1974, now abandoned.

This inveniton relates to a package. In one aspect it relates to a container having a rupturable sealing partition associated therewith. In another aspect the invention relates to a container having a rupturable sealing partition separating a lower portion of the container from an upper portion of the container. In still another aspect the invention relates the a method for handling a product utilizing a container having a rupturable partition located between a lower portion and an upper portion thereof.

The economic advantages of distributing, shipping, and handling packaged products which weigh as little as possible and modern techniques of deyhdration or liquid removal from many products have led to the existence of many products which are distributed and sold in a dried or dehydrated form. The customer than adds another ingredient, in this case water or another suitable liquid, to the dehydrated or dried product which he has purchased in order to produce or reconstitute the desired end product. A container which minimized the need for measuring and/or mixing equipment in conjunction with converting the product material packaged therein to its intended final state is therefore desirable.

Accordingly, it is an object of the invention to provide a new and improved package. A further object is to provide a container having a rupturable partition separating a lower portion from an upper portion thereof. Another object of the invention is to provide a container suitable for mixing another ingredient, such as a liquid or other material, with a material packaged within the container. Yet another object of the invention is to provide a method for handling a product material.

In accordance with the present invention a container having a lower body portion and an upper body portion with an intermediate body portion located between the upper and lower portions has the bottom portion thereof sealed with a rupturable sealing partition adhered to the container and extending across the container at the intermediate portion thereof to isolate the upper and lower portions of the container. A product contained in the lower portion of the container is therefore sealed within the container by means of the rupturable sealing partition. A closure member can then be inserted into the container at a position above the rupturable sealing partition in order to protect the sealing partition from premature rupture during the shipping and handling associated with distribution and sale of the packaged product.

When the product is to be used, the protective cover is removed from the container, exposing the rupturable sealing partition, and the upper portion of the container above the sealing partition is used as a measuring device to provide the desired amount of added ingredient, such as liquid or other material, for mixing with the product material contained in the lower portion of the container. The rupturable sealing partition is then ruptured, permitting the added ingredient in the upper portion of the container to flow into the lower portion of the container and the blend with the product material contained therein.

Additional objects and advantages of this invention will be apparent from the following specification and claims including a detailed description of the drawings in which:

Figure 1:
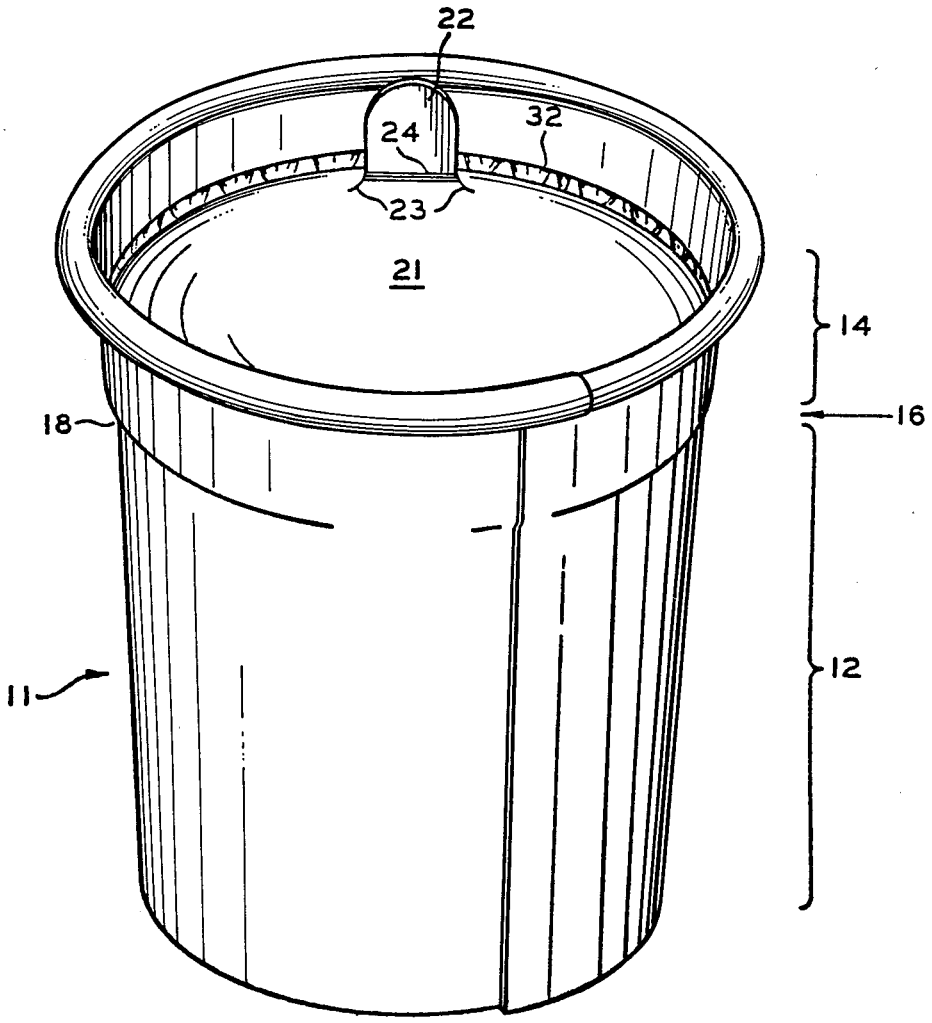
FIG. 1 is a perspective view of a package embodying the invention.
Figure 3:
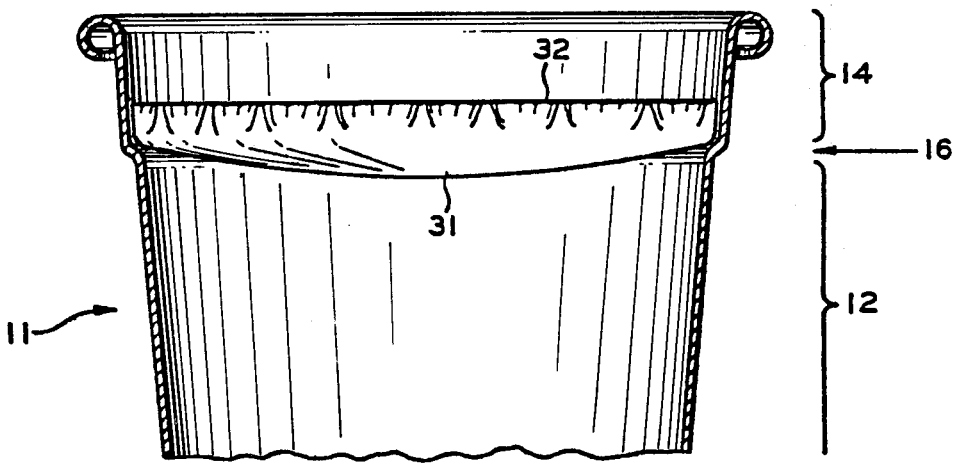

FIG.3 is a cross sectional partial view of the same container with the closure member removed. Referring now to FIG. 1, the package has a container 11 and a closure member 21. The container body has a generally circular cross section, with a bottom portion 12, a top portion 14, and, located between the bottom portion 12 and the top portion 14, an intermediate portion 16. The container 11 can be formed of any suitable material including paperboard, plastic, plastic-coated paperboard, or other similar materials; can be of any cross sectional shape including circular, oval, substantially rectangular, or any other desired shape having a continuous curved, multiple straight, or multiple curved side segments; can be of any construction suitable for making the desired shape of container such as convolute wound, spiral wound, thermal formed, injection molded, of other acceptable construction. The sides of the container body 11 can be substantially vertical or can taper with the container becoming increasingly wider toward the top of the container body. For purposes of illustration, a preferred convolute-formed container of paperboard or plastic-coated paperboard having a generally frustoconical overall shape with the narrower portion of the container being at the bottom thereof and having a substantially circular cross section is shown in FIG. 1. In addition to the overall frustoconical shaped of the container, an additional annular frustoconical flange 18 extends outwardly and upwardly around the container body 11 at the intermediate portion 16 thereof.

The closure member 21 is a generally cylindrical disc-shaped member having a perimeter of proper shape and size to provide a friction fit with the container body 11 at its desired location within the container. The closure member 21 can also be equipped with a tab means 22 for gripping the closure member 21 when removal from the container 11 is desired. The tab 22 can be either a separately attached member or can be formed as a part of the closure member 21 with arcuate score lines 23 and a perimeter score line 24 permitting the tab 22 to be bent upwardly from the disc portion of closure member 21 without substantially deforming the perimeter shaped of the closure member 21.

The container 11 is also equipped with a bottom member (not shown). The bottom member can be of any type suitable for use with the desired container and compatible with the packaging of the product material contained therein and can be constructed and attached by any means known in the art.

Figure 2:
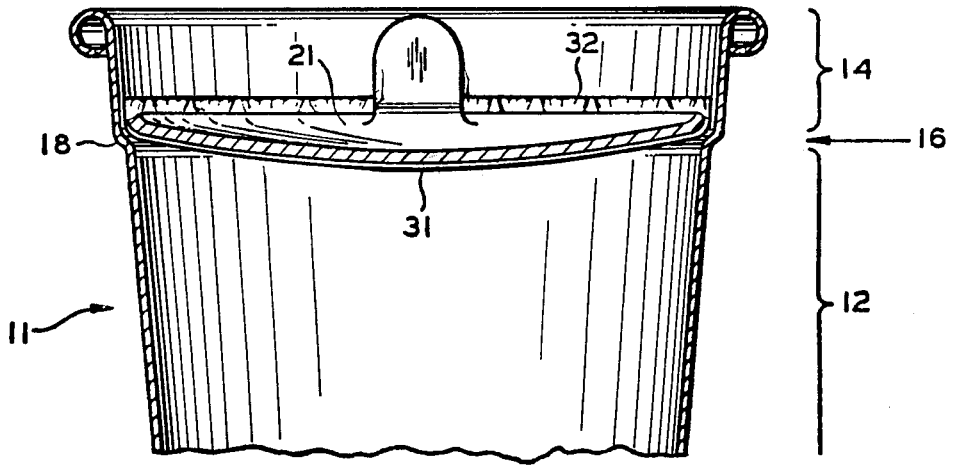
FIG. 2 is a cross sectional partial view of the package of FIG. 1.

In FIG. 2 the outwardly extending frustoconical flange 18 located at the intermediate portion 16 of the container 11 can be recognized as being useful in providing a seat upon which the closure member 21 can be retained. A rupturable sealing partition 31 extends completely across the container at the intermediate portion 16 thereof and is adhered to the inside of the container 11. Although the rupturable sealing partition can be adhered to the container in any manner consistent with the type of container construction, a preferred method is illustrated wherein an apron portion 32 of the rupturable sealing partition 31 is folded upwardly along the perimeter of the rupturable sealing partition and is adhered to the wall of the container 11 in a manner permitting the closure member 21 to be inserted within the container 11 to overlap the apron portion 32 of the rupturable sealing partition 31 and to thereby aid in insuring that the seal between the apron portion 32 and the container 11 is not disturbed. In addition, location of the closure member 21 above the main portion of the rupturable sealing partition 31 safegaurds against inadvertent rupture of the sealing partition 31.

FIG. 3 illustrates the placement of the rupturable sealing partition 31 within the container body 11. The rupturable sealing partition 31 can be constructed of any material or combination of materials suitable for providing a seal adequate to protect the product material contained in the lower portion 12 of the container and capable of being ruptured with the application of a reasonable force. Metal foils, such as aluminum foil or foils of other similar metals or alloys, plastic foams or films, paper or impregnated paper materials such as wax paper, and combinations of these various material can be used as the rupturable sealing partition 31. Presently preferred sealing partitions are those made from metal foil, particularly aluminum foil, or metal foil laminated with a plastic film, such as a normally solid polyolefin film. A laminate of aluminum foil and polyethylene film combines the respective physical properties of both materials and takes advantage of the sealing characteristics of both materials. When such a combination is use one layer of foil and one layer of film can be used or more than one layer of either or both of the materials can be laminated together. When the rupturable sealing partition 31 is located within and affixed to the container as illustrated in FIG. 3, the partition 31 should be of the same general cross sectional shape as the container 11 but should be enough larger than the container cross section to permit an apron portion 32 of the partition to be sealed to the container 11.

For products not requiring protection from humidity or other similar protection necessitating a continuous and airtight seal between the rupturable sealing partition 31 and the container 11, the apron portion 32 of the partition 31 can be adhered to the container body 11 at a plurality of points around the circumference of the apron portion 32 as required to safeguard the contents of the lower portion 12 of the container, to provide sufficient strength to suport the additional ingredient to be mixed with the contained product, and the prevent undue leakage past the sealing partition 31 during the measuring of material to be mixed with the packaged product. For products requiring greater protection, a substantially continuous seal around the apron portion 32 permits excellent resistance to contamination of or tampering with the contents of the lower portion 12 of the container. Sealing of the apron portion 32 of the rupturable partition 31 to the container body 11 can be accomplished using hot melt adhesives, pressure sensitive adhesives, other adhesives, or, if a plastic or laminated plastic sealing partition is used wherein the material or layer of material along the apron portion 32 of the partition 31 in contact with the container 11 is normally solid thermoplastic material, heat sealing of the plastic material associated with the sealing partition to the wall or a coating on the wall of the container body 11 can be used to adhere the rupturable sealing partition 31 to the container 11. Application of the closure member 21 as shown in FIGS. 1 and 2 then aids in maintaining the seal between the apron portion 32 of the sealing partition 31 and the container 11.

The entire volume of the container above the rupturable sealing partition 31, generally defined as the upper portion 14 of the container, is available for measuring the added ingredient, such as a liquid or other material, which is to be added to the contents of the lower portion 12 of the container. The upper portion 14 can be of any relative height or volume as compared to the lower portion 12 of the container, depending on the nature of the product contained within the lower portion 12 of the container and the nature of the added ingredient which the upper portion 14 is intended to measure. To aid in measuring a proper amount in the upper portion 14 of the container, printed indicia or other suitable identifying means may be applied to the inside of the container on the upper poriton 14 thereof.

Positioning of the rupturable sealing partition 31 immediately above the flange 18 enables 18 to aid in maintaining a tight seal around the sealing partition 31 and to help support the weight of the material being measured in the upper portion 14 of the container. Proper cooperation of the flange 18 may reduce the amount and strength of the adhesive bond required between the apron portion 32 of the sealing partition 31 and the container body 11.

To use the package of the invention for packaging and merchandising a product, an appropriate amount of the desired product is first placed within the lower portion 12 of the container 11. The rupturable sealing partition 31 is next inserted into the container to the desired location at an intermediate portion of the container and is sealed to the container. Insertion and sealing of the rupturable sealing partition can be accomplished by using a suitable mandrel adapted to place the sealing partition at the proper location within the container 11 and to heat seal the apron portion 32 of the rupturable partition 31 to the inside of the container. Insertion and sealing of the sealing partition 31 can also be accomplished by any other appropriate means consistent with the type and construction of the container.

The closure member 21 is next inserted into the container at an appropriate position above the rupturable partition 31. Although there can be a substantial distance between the upper surface of the rupturable sealing partition 31 and the lower surfce of the closure member 21, insertion of the closure member 21 to a position immediately adjacent the rupturable sealing partition 31 is presently preferred. In this position the friction fit between the perimeter of the closure member 21 and the inside of the container 11 permits outward pressure around the perimeter of the closure member 21 to assist in maintaining a good seal between the apron portion 32 of the sealing partition 31 and the inside wall of the container 11.

During shipping and handling of the packaged material the closure member 21 covers the vulnerable portion of the rupturable sealing partition 31 and thereby aids in preventing premature rupture of the sealing partition 31. The seal between the sealing partition 31 and the container 11 prevents tampering with the contents of the container since such tampering is nearly impossible without doing some noticeable physical damage to the container or the sealing partition 31 or without visibly disturbing the seal between the sealing partition 31 and the inside of the container.

When the product material within the lower portion 12 of the container is to be used, the closure member 21 is removed from the container. The added ingredient, such as liquid or other material, is introduced into the upper portion 14 of the container to fill the volume above the rupturable sealing partition 31 with a desirable or predetermined volume of material. The rupturable sealing partition 31 is then ruptured using a sharp object, or by any other suitable means, and the material contained in the upper portion 14 of the container is permitted to flow into the lower portion 12 thereof. If thorough mixing of the added ingredient with the product contained in the lower portion 12 of the container is desired, the closure member 21 can be replaced and the container can be shaken or otherwise manipulated to insure the desired degree of mixing. When the desired amount of mixing has been accomplished, the closure member 21 is removed. The sealing partition 31 can then be removed by peeling, tearing, cutting, or otherwise separating it from the container, and the mixed product material is ready to be dispensed as desired. Depending on the product involved, the container may be of such shape and size as to permit consumption or use of the contained mixture directly from the container or, in other circumstances, the mixture may be transferred to a separate container for actual use or consumptiom.

The above descrubed package and method are particularly useful for packaging dehydrated food, dried dog food, and other similar items but can also be used for a wide variety of additional purposes. Variation in shape, size, relative dimension, material, and other aspects of the described embodiment as well as other reasonable modifications and variations can be made within the scope of the invention by those skilled in the art. For example, the container 11 can be provided with an outwardly directed, inwardly opening annular groove in the intermediate section to retain a closure having an outwardly directed annular bead at the junction of the closure disc section and an upwardly directed sidewall section. The rupturable sealing partition 31 can also be spaced downwardly from the closure 21 to permit the second material to be packaged within the upper portion of the container, separately from the primary material in the lower portion of the package.

These and other reasonable variations and modifications are posible within the scope of the foregoing disclosure and the appended claims to the invention.

I claim:

1. A method of handling a product material, said method comprising sequentially:

inserting said product material into the lower portion of a container;

placing a rupturable sealing partition across said container at an intermediate portion of said container, said intermediate portion being located above said lower portion containing said product material, said rupturable sealing partition separating the lower product containing portion of said container from an upper measuring portion of said container;

adhesively bonding rupturable sealing partition to the inside wall of said container;

inserting a closure member into said container to a position above said rupturable sealing partition to protect said rupturable sealing partition until said product material is to be used;

removing said closure member when said product material to be used;

filling a portion of said measuring portion of said container located above said rupturable sealing partition with a desired amount of a liquid; and rupturing said sealing partition to permit said liquid to enter said lower portion of said container.

2. A method in accordance with claim 1 wherein said adhesive bond forms a substantially continuous seal around said inside wall of said container to provide a substantially airtight seal.

3. A method in accordance with claim 1 comprising the additional step of calibrating said measuring portion of said container to aid in filling a portion of said measuring portion of said container with a desired amount of said liquid.

4. A method in accordance with claim 3 wherein said step of calibrating said measuring portion of said container comprises placing printed indicia on the inside of said measuring portion of said container.

5. A method in accordance with claim 1 additionally comprising:

replacing said closure member;

agitating said container to mix said liquid with said product material; and dispensing the mixed product material and liquid from said container.

6. A method in accordance with claim 1 wherein said step of adhesively bonding said rupturable sealing partition to the inside wall of said container comprises:

folding said rupturable sealing partition upwardly along the perimeter of said rupturable sealing partition to thereby form an upwardly depending skirt; and adhesively bonding said upwardly depending skirt to the inside wall of said container.

7. A method in accordance with claim 6 wherein said step of inserting said closure member into said container to a position above said rutpurable sealing partition comprises inserting said closure member into said container in such a manner that said upwardly depending skirt is between the perimeter of said closure member and the inside wall of said container so as to insure that the seal between said rupturable sealing partition and the inside wall of said container remains undisturbed.

* * * * *

UNITED STATES PATENT AND TRADEMARK OFFICE

CERTIFICATE OF CORRECTION

PATENT NO. : 4,207,725

DATED : June 17, 1980

INVENTOR(S) : Ernest L. Smith

It is certified that error appears in the above-identified patent and that said Letters Patent are hereby corrected as shown below:

Column 6, line 5, after "bonding" insert --- said ---;

line 12, after "material", insert --- is ---;

line 49, delete "rutpurable" and insert --- rupturable ---.

Signed and Sealed this

*Eleventh* Day of *August 1981*

[SEAL]

*Attest:*

GERALD J. MOSSINGHOFF

*Attesting Officer*

*Commissioner of Patents and Trademarks*